US007189052B2

(12) United States Patent
Jones

(10) Patent No.: US 7,189,052 B2
(45) Date of Patent: Mar. 13, 2007

(54) CENTRIFUGAL COMPRESSOR HAVING ROTATABLE COMPRESSOR CASE INSERT

(75) Inventor: Daniel W. Jones, Lenexa, KS (US)

(73) Assignee: Accessible Technologies, Inc., Lenexa, KS (US)

( * ) Notice: Subject to any disclaimer, the term of this patent is extended or adjusted under 35 U.S.C. 154(b) by 85 days.

(21) Appl. No.: 10/906,751

(22) Filed: Mar. 4, 2005

(65) Prior Publication Data

US 2006/0093477 A1 May 4, 2006

Related U.S. Application Data

(60) Provisional application No. 60/624,855, filed on Nov. 3, 2004.

(51) Int. Cl.
*F04D 29/44* (2006.01)

(52) U.S. Cl. ..... 415/88; 415/122.2; 415/170.1; 415/206

(58) Field of Classification Search ..... 415/88, 415/122.1, 124.1, 170.1, 182.1, 206, 208.1
See application file for complete search history.

(56) References Cited

U.S. PATENT DOCUMENTS

| | | | | |
|---|---|---|---|---|
| 1,465,097 | A * | 8/1923 | Sherzer | 415/227 |
| 3,139,831 | A | 7/1964 | Pollak | |
| 3,145,970 | A | 8/1964 | Treirat | |
| 3,824,029 | A * | 7/1974 | Fabri et al. | 415/109 |
| 4,752,183 | A * | 6/1988 | Sakurai | 415/12 |
| 4,886,417 | A * | 12/1989 | Remstad et al. | 415/208.3 |
| 5,156,522 | A | 10/1992 | Tessier | |
| 5,224,459 | A * | 7/1993 | Middlebrook | 123/559.1 |
| 5,961,281 | A | 10/1999 | Ojima et al. | |
| 5,975,845 | A | 11/1999 | Ball | |
| 5,980,203 | A | 11/1999 | Zatorski et al. | |
| 6,234,749 | B1 | 5/2001 | Hasegawa et al. | |
| 6,273,671 | B1 | 8/2001 | Ress, Jr. | |
| 6,439,208 | B1 | 8/2002 | Jones | |
| 6,478,016 | B1 | 11/2002 | Roderique | |
| 6,478,469 | B1 | 11/2002 | Jones | |
| 2004/0109760 | A1 | 6/2004 | Jones | |

* cited by examiner

*Primary Examiner*—Igor Kershteyn
(74) *Attorney, Agent, or Firm*—Hovey Williams LLP

(57) ABSTRACT

A centrifugal compressor is disclosed as including a case, a compressor chamber, and an impeller in the compressor chamber for compressing fluid from an inlet opening and forcing compressed fluid through an outlet opening. Moreover, the compressor includes an insert rotatably supported on the case. The insert is adjacent the impeller and serves to minimize catastrophic compressor failure that might otherwise occur as a result of contact between the impeller and compressor chamber wall.

89 Claims, 3 Drawing Sheets

CENTRIFUGAL COMPRESSOR HAVING ROTATABLE COMPRESSOR CASE INSERT

RELATED APPLICATIONS

This application claims the priority of Provisional Application Ser. No. 60/624,855, filed Nov. 3, 2004, entitled CENTRIFUGAL SUPERCHARGER HAVING ROTATABLE VOLUTE INSERT, which is hereby incorporated by reference herein.

BACKGROUND OF THE INVENTION

1. Field of the Invention

The present invention relates generally to the field of centrifugal compressors. More specifically, the present invention concerns a centrifugal compressor with a rotatable case insert for minimizing the risk of crashing caused by contact between the impeller and case wall.

2. Discussion of Prior Art

Centrifugal compressors are commonly employed in applications where fluid compression requirements involve high volumetric flow rates. Examples of such applications include liquid pumps and forced air induction systems using superchargers or turbochargers. Centrifugal compressors typically achieve high flow rates with vaned impellers that turn at extremely high rates of angular velocity, as high as 30,000 to 70,000 rpm. These high rotational speeds quickly expose wear and failure modes of the compressor.

For example, an impeller generally rotates within a chamber of a stationary compressor case. The vanes of the impeller rotate next to an annular wall formed as part of the case. Clearances between the impeller and the wall are designed to be tight in order to maximize compressor efficiency. One risk of this necessary arrangement is the possibility of contact between the impeller and case, which can cause the impeller and impeller bearings to experience violent shock loading and, in some instances, catastrophic compressor crashing or failure. It has been determined that such contact is sometimes attributable to localized superheating of the impeller and wall occurring along isolated areas where the clearance becomes too small. Superheating is also a function of the relative difference in angular velocity between the wall and impeller, referred to as the velocity variance. As superheating occurs, material from the impeller has a tendency to build up on the wall which effectively reduces the clearance. The superheating and associated material build-up also tend to rob the impeller of energy by reducing its speed. If the build-up of material continues to grow and is not eliminated, the impeller and wall can contact each other. In any case, there is a need for an improved centrifugal compressor that minimizes the risk of damage, poor performance, and catastrophic failure caused by contact between the impeller and case or superheating of the impeller and case.

SUMMARY OF THE INVENTION

The present invention provides centrifugal compressor that does not suffer from the problems and limitations of the prior art centrifugal compressors detailed above. In particular, a first aspect of the present invention concerns a centrifugal compressor that is driven by a power source to supply compressed fluid. The centrifugal compressor broadly includes a case, a compressor chamber defined between an inlet opening and a spaced outlet opening, a rotatable impeller in the compressor chamber, and a rotatable insert that encircles at least a portion of the impeller. The case and insert each define at least a portion of the compressor chamber. The impeller is operable to compress fluid from the inlet opening and force compressed fluid through the outlet opening when rotated by the power source. Moreover, the insert is rotatable relative to the case.

A second aspect of the present invention concerns a centrifugal compressor that is driven by a power source to supply compressed fluid. The centrifugal compressor broadly includes a case, a rotatable impeller operable to compress fluid when rotated by the power source, and a rotatable insert. The insert is spaced from the impeller and encircles at least a portion of the impeller. The insert is rotatably supported on the case to spin relative thereto in response to contact with the rotatable impeller.

A third aspect of the present invention concerns a centrifugal compressor that is driven by a power source to supply compressed fluid. The centrifugal compressor broadly includes a case, a rotatable impeller operable to compress fluid when rotated by the power source about an impeller axis, and a case insert assembly. The case insert assembly includes an insert adjacent the impeller and a bearing rotatably supporting the insert on the case for rotation about the impeller axis.

A fourth aspect of the present invention concerns a forced air induction system for providing compressed intake fluid to an engine. The system broadly includes a centrifugal compressor operable to compress the intake fluid. The compressor further includes a case that presents a compressor chamber defined between an inlet opening and a spaced outlet opening, a rotatable impeller in the compressor chamber, and a rotatable insert that encircles at least a portion of the impeller. The case and insert each define at least a portion of the compressor chamber. The outlet opening is fluidly connectable to the engine. The impeller is operable to compress fluid from the inlet opening and force compressed fluid through the outlet opening when rotated. Moreover, the insert is rotatable relative to the case.

The fifth aspect of the present invention concerns a forced air induction system for providing compressed intake fluid to an engine. The system broadly includes a centrifugal compressor operable to compress the intake fluid. The compressor further includes a case, a rotatable impeller operable to compress the intake fluid when rotated, and a rotatable insert. The insert is spaced from the impeller and encircles at least a portion of the impeller. The insert is rotatably supported on the case to spin relative thereto in response to contact with the impeller.

The sixth aspect of the present invention concerns a forced air induction system for providing compressed intake fluid to an engine. The system broadly includes a centrifugal compressor operable to compress the intake fluid. The compressor further includes a case, a rotatable impeller operable to compress the intake fluid when rotated about an impeller axis, and a case insert assembly. The case insert assembly includes an insert adjacent the impeller and a bearing rotatably supporting the insert on the case for rotation about the impeller axis.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

DETAILED DESCRIPTION OF THE PREFERRED EMBODIMENTS

Figure 2:
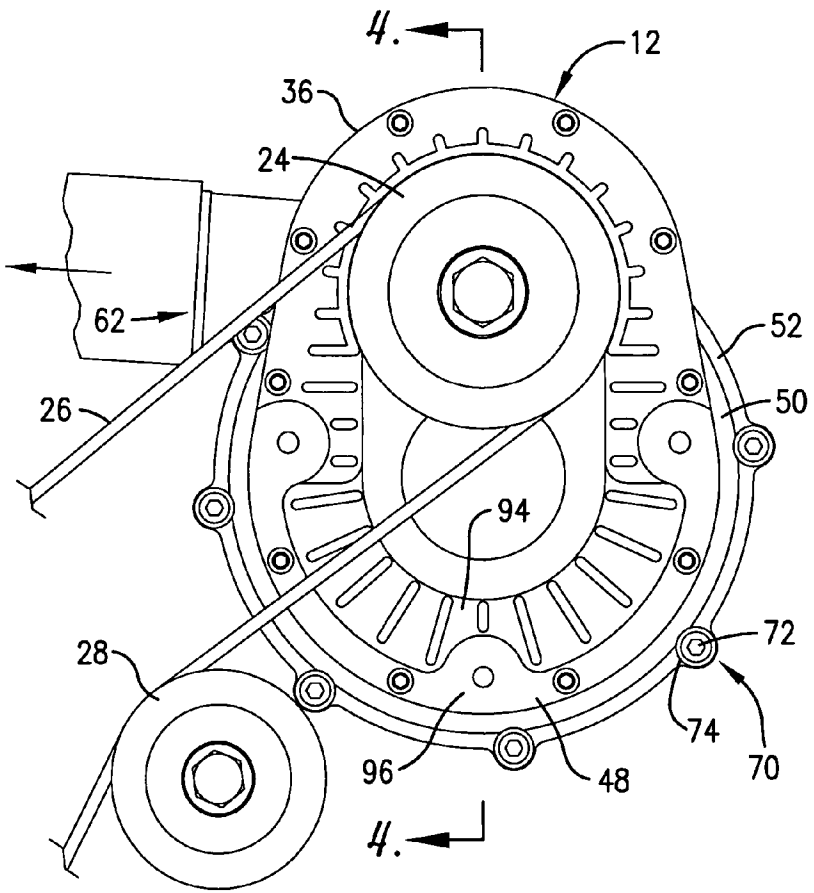
FIG. 2 is an enlarged, fragmentary front elevational view of the engine depicted in FIG. 1.
Figure 1:
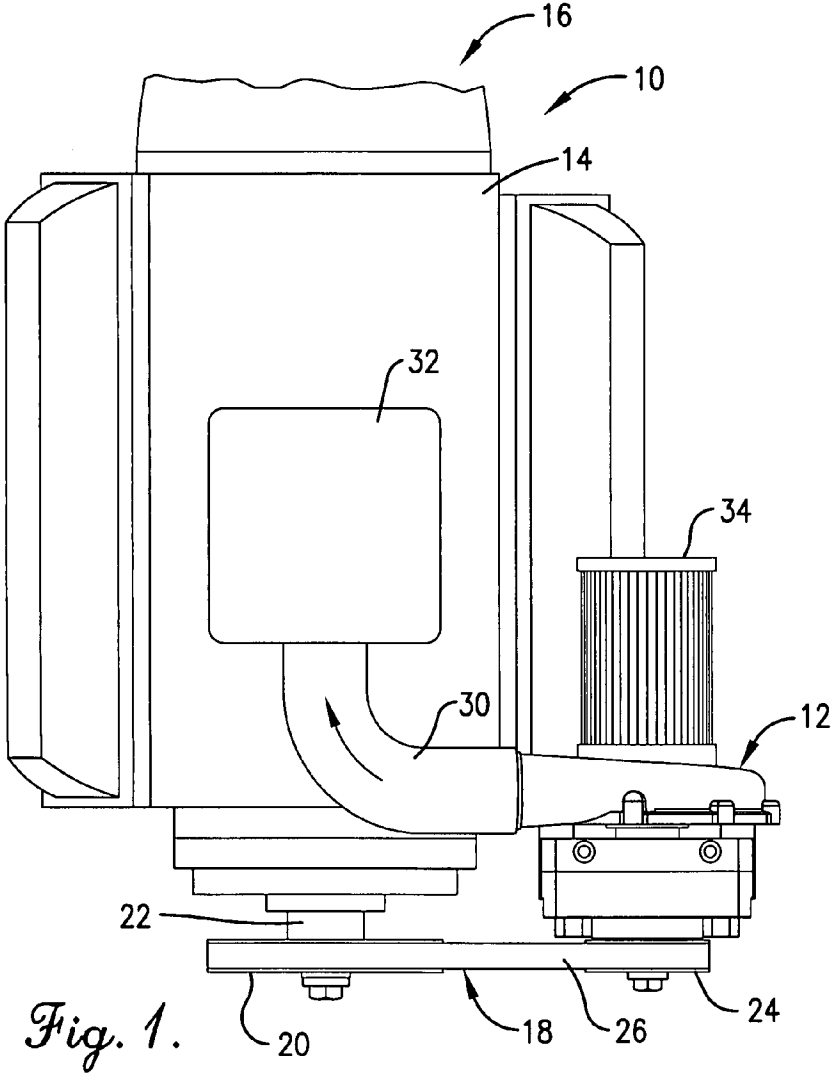
FIG. 1 is a fragmentary, partially schematic plan view of an internal combustion engine including a centrifugal supercharger constructed in accordance with the principles of the present invention.

FIGS. 1 and 2 illustrate a forced air induction system 10 utilizing a centrifugal supercharger 12 constructed in accordance with a preferred embodiment of the present invention. The supercharger 12 illustrated in FIG. 1 is shown in use with an engine 14 of a vehicle 16 such as an automobile. However, it is consistent with the principles of the present invention that the vehicle 16 could also be a motorcycle, an aircraft, or a powered marine craft.

FIG. 1 also illustrates the supercharger 12 utilized for supplying intake fluid to a reciprocating engine 14. However, the principles of the present invention are equally applicable to centrifugal compressors in other applications. For example, it is within the ambit of the present invention to power the illustrated compressor by connecting it to the associated engine 14 using a mechanical drive unit (e.g. as in a supercharger), an exhaust drive unit (e.g. as in a turbocharger), or using other mechanisms associated with forced air induction systems. Similarly, the compressor could be powered by a prime mover other than a reciprocating engine to provide compressed intake fluid, such as a turbine engine or an electric motor.

It is also within the ambit of the present invention to use the illustrated compressor in other fluid-compressing applications, such as industrial fluid-handling systems or compressor stations for fluid transmission lines. The compressor could again be powered by various prime movers, such as reciprocating engines, turbine engines, or electric motors.

Returning to the illustrated embodiment, the forced air induction system 10 includes a drive unit 18 for drivingly and mechanically connecting the supercharger 12 to the engine 14. The illustrated drive unit 18 comprises a belt drive. The belt drive 18 preferably includes a drive sheave 20 fixed to a crankshaft 22 of the engine 14, a driven sheave 24 associated with supercharger 12 (as will be described further below), a belt 26 entraining the sheaves 20 and 24, and an idler sheave 28 for adjustably tightening the belt 26. It will be appreciated that the principles of the present invention contemplate alternative drive units, beyond those already noted. For example, the drive unit could alternatively include a cogged belt or a chain interconnecting a pair of toothed sheaves or sprockets, respectively (all not shown).

The illustrated induction system 10 further includes a conduit 30 fluidly communicating the supercharger 12 with the engine intake 32. If desired, the system 10 also includes an intercooler (not shown) fluidly disposed between the supercharger 12 and intake 32 for cooling the compressed intake fluid. Yet further, the induction system 10 includes a filter 34 (see FIG. 1) preferably provided to filter air supplied to the supercharger 12. Although the filter 34 is shown immediately adjacent the supercharger 12, it is entirely within the ambit of the present invention to space the filter 34 somewhere upstream from the the supercharger 12. Although not illustrated, the supercharger 12 may alternatively communicate with a forwardly open conduit (not shown). An example of this application occurs in many powered vehicles, where the conduit extends toward the front of the powered vehicle, such that air flow to the supercharger 12 is facilitated when the vehicle is moving in a forward direction.

Figure 4:
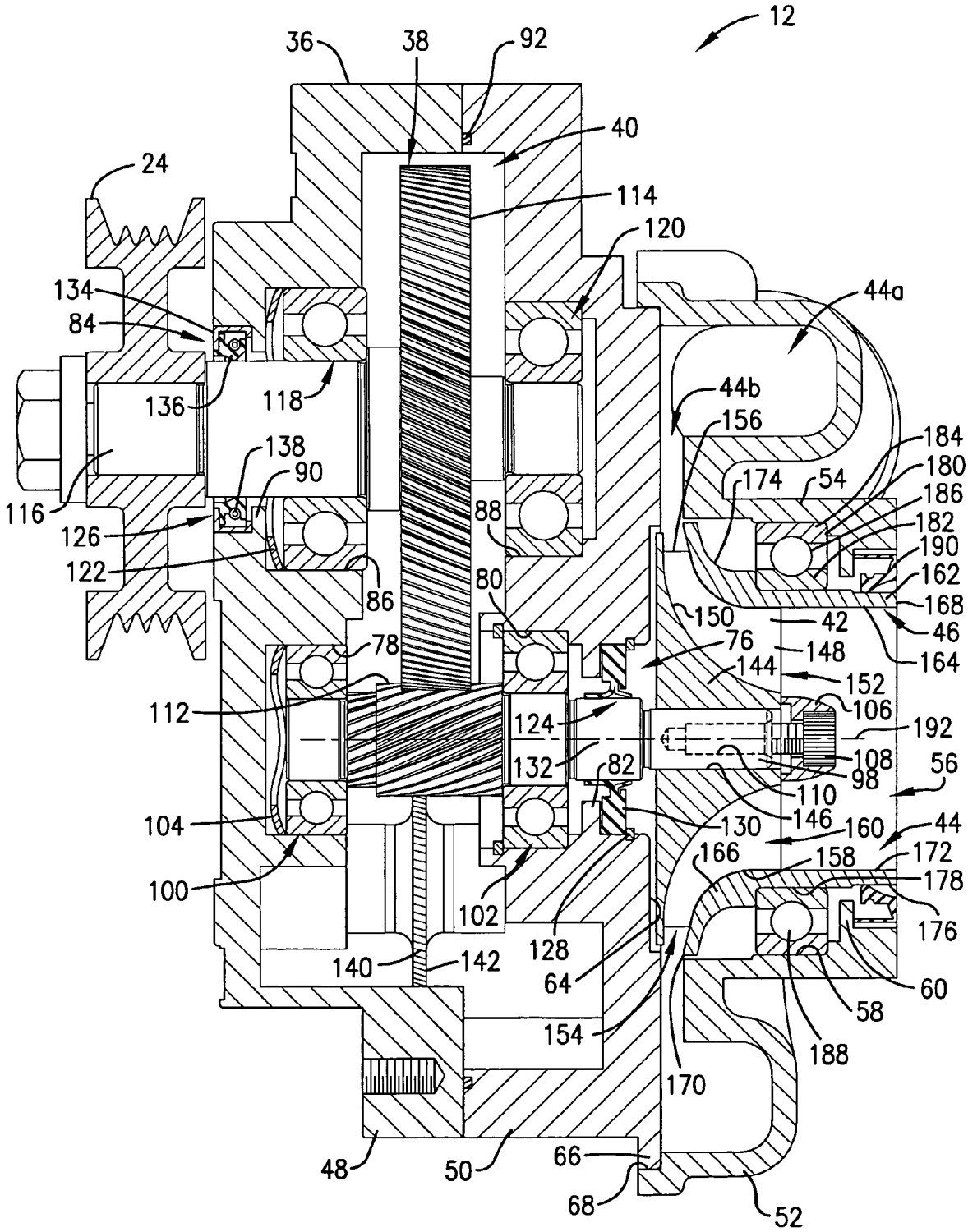
FIG. 4 is a further enlarged cross-sectional view of the supercharger taken generally along line 4—4 of FIG. 2, illustrating the assembled centrifugal compressor, including the rotatable impeller and the rotatable insert.

As perhaps best shown in FIG. 4, the preferred embodiment of the centrifugal supercharger 12 broadly includes a case 36, a transmission 38 at least substantially housed within a transmission chamber 40, an impeller 42 located within a compressor chamber 44, and a case insert assembly 46. As will be described, the case insert assembly 46 is particularly effective in minimizing the risk of catastrophic failure, superheating of the impeller 42 and case 36, and other problems noted and apparent from the description herein.

Figure 3:
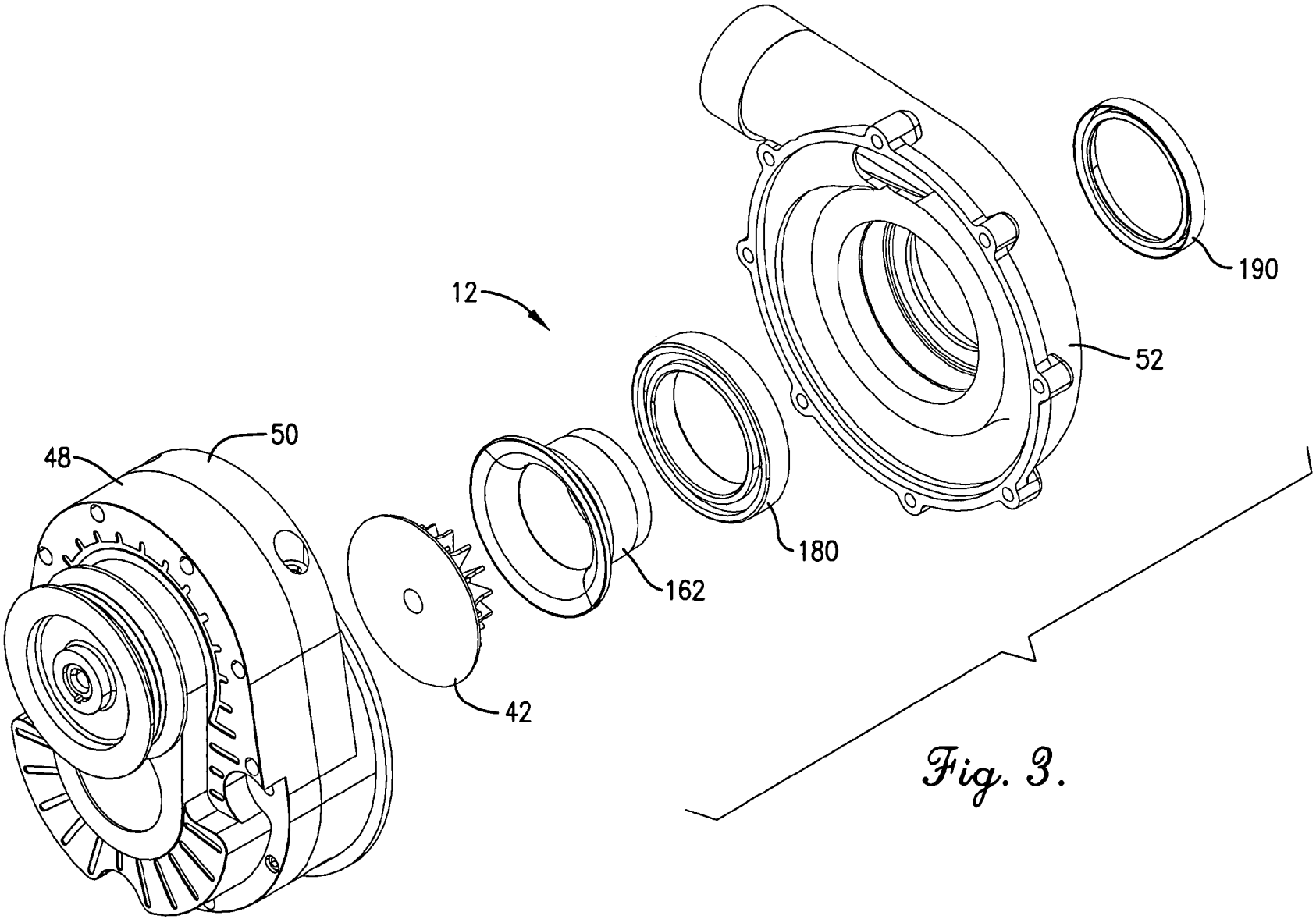
FIG. 3 is an exploded isometric view of the centrifugal supercharger, particularly illustrating the impeller and case insert assembly prior to assembly.

The case 36 of the illustrated supercharger 12 includes three main sections 48,50,52 that are formed of any suitable material (e.g., polished cast steel) and interconnected as will be described (see FIGS. 3 and 4). In the preferred form, the case sections 48 and 50 cooperatively define the transmission chamber 40. Furthermore, the case sections 50,52 and the case insert assembly 46 cooperatively define the compressor chamber 44, as will be described. The case 36 may be alternatively configured for applications where the compressor is used in other kinds of air induction systems or industrial fluid-compressing systems as hereinabove described.

Those ordinarily skilled in the art will appreciate that incoming fluid (e.g., air, air/fuel mixture, etc.) is pressurized and accelerated within the compressor chamber 44. The case section 52 includes a substantially cylindrical inlet portion 54 (see FIG. 4). The cylindrical inlet portion 54 defines a central inlet opening 56 through which fluid enters the chamber 44. Within the case section 52 and adjacent the inlet opening 56, the case section 52 provides a socket 58 and a dividing wall 60, the use of which will be subsequently described. As discussed above, the illustrated filter 34 (see FIG. 1) is attached directly to the supercharger 12 at inlet opening 56.

The case section 52 is configured in such a manner that a volute section 44*a* of the compressor chamber 44 extends circumferentially around the cylindrical inlet portion 54 with a progressively increasing diameter. Between the volute section 44*a* and the inlet opening 56 is a diffuser section 44*b* of the chamber 44. The diffuser section 44*b* is shown to be devoid of vanes. However, one of ordinary skill in the art would appreciate that the present invention may incorporate a vaned diffuser. The volute section 44*a* of the compressor chamber 44 terminates at a tangential outlet opening 62 (see FIG. 2), with the latter communicating with the engine intake 32 via conduit 30 (see also FIG. 1). In this regard, fluid entering the illustrated compressor chamber 44 flows axially through the inlet opening 56, is propelled generally radially through the diffuser portion 44*b* into the volute section 44*a*, and then directed along a generally circular path to the outlet opening 62.

As shown in FIG. 4, the case section 50 presents a circular recess 64 for purposes which will be described. In addition, the section 50 presents an outwardly projecting lip 66 that extends partly around the perimeter thereof (e.g., see FIGS. 2 and 4). The lip 66 is received in a complemental groove 68 defined in the case section 52, and a plurality of fastener assemblies 70 (see FIG. 2) serve to secure case section 52 and case section 50 to one another. Each of the fastener assemblies 70 preferably includes a threaded screw 72 received in the case section 52 and a washer 74 pressed against the lip 66.

An impeller shaft opening 76 that is concentric with the inlet opening 56 extends through the case section 50 from the compressor chamber 44 to the transmission chamber 40. Defined in the case sections 48 and 50 in axial alignment with the shaft opening 76 are a pair of opposed bearing assembly sockets 78 and 80. An inwardly projecting dividing wall 82 is located along the shaft opening 76 to present a seal recess for purposes which will be described.

The case section 48 similarly includes an input shaft opening 84 that is spaced upwardly from the bearing assembly socket 78. Similar to the impeller shaft opening 76, the input shaft opening 84 is axially aligned with opposed bearing assembly sockets 86 and 88 defined in the case sections 48 and 50. There is likewise an inwardly projecting dividing wall 90 alongside the bearing assembly socket 86 to present a seal recess as will be described. An endless O-ring 92 retained within a continuous groove defined in the case section 50 provides a seal between the case sections 50 and 48.

As particularly shown in FIG. 2, the illustrated case section 48 presents a finned outer face 94 for promoting heat exchange between the transmission chamber, particularly the lubrication fluid, and atmosphere. The outer face 94 is also provided with a plurality of mounting bosses 96, each being tapped so that a mounting bolt (not shown) may be threaded therein to fasten the supercharger 12 to a mounting bracket (also not shown) fixed to the engine 14 (or other vehicle component(s)).

The impeller 42 is drivingly connected to the belt drive 18 of the vehicle 16 by the transmission 38 located generally in the transmission chamber 40. The transmission 38 may be variously configured but at least some component(s) thereof preferably require(s) continuous lubrication during operation.

As discussed in detail below, in the preferred embodiment, the transmission 38 includes an impeller shaft 98 rotatably supported by a pair of bearing assemblies 100 and 102 press fit within the respective sockets 78 and 80. In the usual manner, a wavy spring washer 104 is provided in at least one of the sockets 78 and 80. In an alternative embodiment, the bearing assemblies 100 and 102 have an inventive construction that serves to extend bearing life without sacrificing speed of the shaft 98, cost or simplicity in construction. Such an arrangement is disclosed in commonly owned U.S. Pat. No. 6,478,469, issued Nov. 12, 2002, entitled VELOCITY VARIANCE REDUCING MULTIPLE BEARING ARRANGEMENT FOR IMPELLER SHAFT OF CENTRIFUGAL SUPERCHARGER, which is hereby incorporated by reference herein as is necessary for a full and complete understanding of the present invention.

The illustrated impeller shaft 98 projects through the opening 76 and into the compressor chamber 44. As will be described in more detail hereinbelow, the impeller 42 is received on the end of the shaft 98, with the impeller 42 preferably being pressed onto the shaft 98 and retained thereon by a cap 106. It is noted that the cap 106 is secured in place by a screw 108 threaded into an axial bore 110 of the shaft 98. When it is desired to remove the impeller 42 from the shaft 98, the case section 52 is detached from the case section 50 and the retaining screw 108 and cap 106 are removed. The impeller 42 is then forcibly slid off of the shaft 98.

In the illustrated embodiment, the shaft 98 presents a cantilevered section (i.e., the portion of the shaft 98 projecting to the right of the bearing assembly 102 when viewing FIG. 4) on which the impeller 42 is mounted. However, it is entirely within the ambit of the present invention to alternatively support the impeller shaft 98 on both sides of the impeller 42. For example, a suitable alternative construction might involve lengthening the impeller shaft so that it projects beyond the impeller and providing a bearing assembly in the compressor chamber between the shaft and case.

The impeller shaft 98 is preferably machined to present a pinion 112 located between the bearing assemblies 100,102. The pinion 112 intermeshes with a relatively larger gear 114 supported by an input shaft 116. The gear 114 is preferably keyed to the shaft 116, although these components may be fixedly interconnected in any other suitable manner. Similar to the impeller shaft 98, a pair of bearing assemblies 118 and 120 press fit within respective ones of the sockets 86 and 88 rotatably support the input shaft 116. Additionally, a wavy spring washer 122 is provided in the socket 86 adjacent the dividing wall 90. The input shaft 116 projects through the shaft opening 84 and beyond the outer face 94 of the case section 48.

Those ordinarily skilled in the art will appreciate that the gear-type transmission 38 of the preferred embodiment produces noise that is noticeably greater than other drives, such as a belt drive. It has been determined that the impeller 42 actually amplifies the noise of the transmission 38, and the noise typically associated with a gear driven supercharger is normally considered undesirable. In this regard, the impeller shaft 98 may be designed to dampen noise that might otherwise propagate through the shaft 98 to the impeller 42. Such a shaft construction is disclosed in commonly owned U.S. Pat. No. 6,478,016, issued Nov. 12, 2002, entitled GEAR DRIVEN SUPERCHARGER HAVING NOISE REDUCING IMPELLER SHAFT, which is hereby incorporated by reference herein as is necessary for a full and complete understanding of the present invention.

The pinion 112 is significantly smaller than the drive gear 114 so that the transmission 38 provides a significant step up in rotational speed between the input shaft 116 and impeller shaft 98. For example, during regular operation of the supercharger 12, the illustrated shaft 98 and pinion 112 will reach speeds of up to 30,000 to 70,000 rpm. A suitable pinion 112 diameter is approximately 1.2 inches, with the drive gear 114 being about three times that size.

Those of ordinary skill in the art will also appreciate that, in some applications, the illustrated compressor may not incorporate a transmission within the case 36. Rather, the illustrated compressor may have an input shaft on which the impeller is mounted. In such an alternative, the input/impeller shaft would be coupled to a drive that is turning at the desired impeller speed. This drive may include a prime mover and may also include a similar transmission for achieving rotational speeds well above those of the prime mover.

Because lubrication fluid will be dispersed throughout the transmission chamber 40 in the manner described below, seal assemblies 124 and 126 are provided at the shaft openings 76 and 84, respectively. Turning first to the impeller shaft seal assembly 124, a retaining ring 128 maintains a seal 130 against the dividing wall 82. The seal 130 sealingly engages the case section 50. The seal 130 is formed of any suitable material, such as that available under the designation "TEFLON", and preferably provides double or redundant sealing contact with a seal ring 132 of the impeller shaft 98. On the other hand, the input shaft seal assembly 126 includes a metal case 134 press fit within the case section 48 against the dividing wall 90. The case 134 houses a rubber seal 136 that is sealingly retained between the input shaft 150 and case 134 by a spring 138. The illustrated seal assemblies 124 and 126 are preferred but shall be considered as illustrative only, and the principles of the present invention are equally applicable to a supercharger using various other types of seals.

Those ordinarily skilled in the art will appreciate that the gears 112,114 and, in the preferred embodiment, the bearing assemblies 100,102,118,120 require lubrication during operation. The supercharger 12 is preferably self-contained such that lubrication of the transmission is provided exclusively by a lubricant contained entirely within the transmission chamber 40. The transmission chamber 40 includes a lubricant reservoir portion that is preferably located below the transmission 38. The quantity of fluid within the transmission chamber 40 essentially defines the fluid reservoir portion.

A lubricant slinging disc 140 projects into the reservoir portion so as to be partly submerged in the lubricant. The illustrated disc 140 includes an outer toothed edge 142 that intermeshes with the pinion 112 so that the disc 140 is rotated by the transmission 38. Such an arrangement is disclosed in commonly owned U.S. Pat. No. 6,439,208, issued Aug. 27, 2002, entitled CENTRIFUGAL SUPERCHARGER HAVING LUBRICATING SLINGER, which is hereby incorporated by reference herein as is necessary for a full and complete understanding of the present invention.

As noted in the incorporated application, the disc 140 is suitably fixed (i.e., press fit) to a shaft (not shown) and positioned between a pair of bearing assemblies (not shown) by respective spacers (not shown). The bearing assemblies are press fit within respective sockets and thereby serve to rotatably support the disc 140 within the transmission chamber 40. As with the other shaft assemblies, a wavy spring washer is provided in one of the sockets.

Also noted in the incorporated application, the disc 140 creates a highly desirable lubricating mist within the transmission chamber 40. The mist ensures that the transmission components (i.e., the gears 112,114 and the bearing assemblies 100,102,118,120) are adequately lubricated without creating undesirable hydraulic separation forces.

However, the principles of the present invention are equally applicable to various other supercharger lubrication systems. That is, the present invention is preferably utilized with a self-contained supercharger having a partly filled transmission chamber, although the inventive features can be employed in a supercharger using an outside lubrication source or a supercharger having a fully filled transmission chamber. For example, it is entirely within the ambit of the present invention to lubricate the transmission with engine lubricant or a recirculating lubrication system dedicated to the supercharger. A number of suitable dedicated lubrication systems are disclosed in commonly owned U.S. patent application Ser. No. 10/641,619, filed Aug. 14, 2003, entitled CENTRIFUGAL COMPRESSOR WITH IMPROVED LUBRICATION SYSTEM FOR GEAR-TYPE TRANSMISSION, which is hereby incorporated by reference herein. The alternative supercharger may also include wicks or jet sprayers, rather than the slinging disc 140, for directing lubricant to the transmission components. It is again noted, however, that the illustrated lubrication system is most preferred because a failure of the transmission 38 (e.g., metal fragments produced by broken gear teeth, shaft failures, etc.) does not damage the engine 14. It is further noted that any one of the herein mentioned bearing assemblies may be pre-lubricated such that lubrication during operation is unnecessary.

In the usual manner, the supercharger 12 includes the rotatable impeller 42 located within the compressor chamber 44 (see FIG. 4). The impeller 42 has a circular, solid base (or hub) 144 that is provided with a central mounting hole 146. The impeller 42 also has a plurality of vanes 148 (or blades) extending out from a curved surface 150 of the hub 144 and uniformly disposed around the mounting hole 146. The vanes 148 extend between and cooperatively define an inducer portion 152 of the impeller 42 and an exducer portion 154 where each of the vanes 148 forms an impeller tip 156. Those ordinarily skilled in the art will appreciate that the inducer and exducer portions each comprise a plurality of openings spaced about the circumference of the impeller 42. More particularly, each opening is defined cooperatively by the hub and two adjacent blades and is normally bounded by the adjacent structure of the compressor chamber wall (which in the illustrated embodiment comprises a portion of the case insert assembly 46, as will be described). Each of the vanes 148 also presents a radially outermost curved edge 158 that extends from the inducer portion 152 to the exducer portion 154. In this manner, a pair of adjacent vanes 148 and the curved surface 150 partially define a channel 160 through which fluid passes from the inducer portion 152 to the exducer portion 154. However, it is within the ambit of the present invention that some of the vanes 148 do not extend fully toward the inducer portion 152 (typically, the "shorter" and "longer" blades are in an alternating arrangement about the impeller circumference).

The impeller 42 is preferably machined from a billet of 7075 T-6 aircraft aluminum, although other suitable materials (e.g., cast aluminum) may be used. It is further preferred to use the impeller commercially available from the assignee of record of the invention claimed herein. However, the impeller 42 may be variously configured without departing from the spirit of the present invention.

The impeller 42 is received within the chamber 44 so that the flat circular face of the hub 144 spans and is received in the circular recess 64. In this orientation, the inducer portion 152 is adjacent to the inlet opening 56 and the impeller 42 axis is aligned with the inlet opening 56.

As previously mentioned, the supercharger 12 also includes the rotating case insert assembly 46. The insert assembly 46 includes a rotating insert 162 that includes a generally cylindrical section 164 and a curved section 166 projecting from the cylindrical section 164. The cylindrical section 164 extends from a first end 168 of the insert 162 over part of the insert axial length. The curved section 166 tapers radially outward from the cylindrical section 164 toward a second end 170. The insert 162 presents a smooth inner annular surface 172 that extends from the first end 168 to the second end 170. The insert 162 also presents an outer annular surface 174 that includes a sealing surface 176 adjacent the first end 168 and a bearing receiving surface 178 between the first and second ends 168,170.

The insert 162 is received within the case 36 and is oriented so that the first end 168 is adjacent to the inlet opening 56 and the second end 170 is adjacent to the case section 50. In addition, the cylindrical section 164 of the insert 162 is generally concentric with the cylindrical inlet portion 54 of the case section 52. In the illustrated embodiment, the impeller 42 also extends partly into the insert 162 so that the insert 162 encircles a portion of the impeller 42, although the principles of the present invention are equally applicable to a arrangement in which impeller is wholly received within the insert. The insert 162 is substantially coaxial with the impeller 42, and the impeller 42 is then coaxial with and partially located within the cylindrical inlet portion 54. Moreover, the vanes 148 of impeller 42 are adjacent to the inner annular surface 172, and the curved section 166 of the insert 162 has a shape that closely complements that of the curved edges 158. It will be appreciated that the complemental shapes of the annular surface 172 and curved edges 158 are substantially hyperbolic. Furthermore, the surface 164 and curved edges 158 extend along and are in close proximity to each other.

The illustrated insert 162 cooperates with the case sections 52,50 to define the compressor chamber 44. In particular, the inner annular surface 172 defines at least part of the compressor chamber 44 through which fluid passes between the inlet opening 56 and the outlet opening 62. In particular, the illustrated insert 162 projects from the inlet opening 56 (i.e. the first end 168) generally to the diffuser portion 44*b*. In this regard, the illustrated insert 162 is axially coextensive and located entirely within the cylindrical inlet portion 54. However, the principles of the present invention are equally applicable to various other insert arrangements, such as an insert that is axially shorter or longer than the cylindrical inlet portion 54, an insert that terminates internally or externally of the inlet opening 56, etc.

The insert 162 is radially supported on the case 36, and more preferably the inlet portion 54, by an insert bearing 180 of the insert assembly 46. In the illustrated embodiment, the bearing 180 includes inner and outer races 182,184 and a ball ring 186 interposed between the races 182,184 so that the races 182,184 are rotatable relative to each other in the usual manner. The ball ring 186 includes a cage (not shown) and a plurality of balls 188 retained within the cage. It is within the ambit of the present invention that the illustrated bearing 180 may be substituted with another kind of bearing for supporting the insert 162 such as a roller-type bearing or a journal bearing. In the preferred embodiment, the bearing 180 is pre-lubricated or otherwise has lubrication fluid provided therein.

The insert bearing 180 is received by socket 58 so that the outer race 184 is fixed to the case section 52. The inner race 182 is fixed to the surface 178 of insert 162. The illustrated bearing 180 allows the insert 162 to rotate freely relative to the case section 52.

The insert assembly 46 further includes a seal assembly 190 that is fixed to the cylindrical inlet portion 54 and provides a sealing relationship between the case 36 and the insert 162. The seal assembly 190 is fixed against the dividing wall 60. The seal assembly 190 encircles a portion of the insert 162 and seals against sealing surface 176 of the insert 162. In this manner, the illustrated supercharger 12 has an insert 162 that is free to rotate within the case 36 and that cooperatively defines with the case 36 part of the compressor chamber 44. In particular, the inner annular surface 172 cooperatively defines, along with adjacent vanes 148 and curved surface 150, the channel 160 through which fluid flows as it is driven by the vanes 148 from the inducer portion 152 to the exducer portion 154.

As the impeller 42 rotates within the chamber 44 about an axis 192, fluid flow is induced through the inlet opening 56, through the area bounded by the annular surface 172 and into the inducer portion 152. The vanes 148 force the fluid toward the impeller tip 156, past the diffuser section 44*b*, and into the volute section 44*a*. With respect to the preferred embodiment, the impeller 42, regardless of its design, induces and causes fluid to flow through the compressor chamber 44 as hereinabove described.

In the preferred embodiment, the impeller 42 and insert 162 are free to rotate relative to each other and relative to the case 36. Therefore, as the impeller 42 is spun about its axis, the insert 162 is free to spin in response to applied forces. Due to the construction of the case 36 and the insert 162, the insert 162 may rotate through at least one revolution and is in fact free to spin by rotating through numerous revolutions. However, it is entirely consistent with the principles of the present invention that in some applications, the construction of the insert assembly 46 or the inherent friction within the insert assembly 46 will act to prevent rotation of the insert 162 (e.g., as a result of friction within the bearing 180, friction due to sealing contact between the insert 162 and the seal assembly 190, etc.). Most preferably, the case insert assembly 46 is configured so that the insert 162 remains stationary during compression of the fluid, except when caused to rotate by contact with the impeller 42.

As previously discussed, the impeller 42 and insert 162 generally have a gap therebetween that allows relative rotation. In the event that the gap becomes too small or an interference condition exists between the impeller 42 and insert 162, the illustrated insert 162 is free to rotate in response to rotational forces applied directly (or indirectly) by the impeller 42. It has been determined that in most instances such forces will likely cause the insert 162 to spin at some angular velocity less than the impeller's angular velocity. In this manner, the relative angular velocity (or velocity variance) between the insert 162 and the impeller 42 is significantly reduced in response to contact (or near-contact) therebetween.

Although less desirable, the principles of the present invention are also applicable to an insert that is mechanically driven so that the relative angular velocity between the insert and the impeller may be maintained at a predetermined percentage of the impeller velocity. For example, this may be accomplished by driving the insert with the impeller directly or by another portion of the supercharger, utilizing a transmission to impart the desired gear ratio between the insert and the impeller. Alternatively, the insert may be designed to rotate at the same rate as the impeller to eliminate the relative angular velocity.

While the illustrated case 36 and insert 162 are preferably formed of a suitable, durable material, such as polished cast steel, it is within the ambit of the present invention to utilize relatively softer materials for the insert 162 or on the inside of the case 36. For example, either the case 36 or the insert 162 may incorporate an insert, particularly surrounding the impeller 42, to desirably reduce the tolerances between the inside of the case 36 or the insert 162 and the moving impeller 42 housed therein while reducing the risk of catastrophic failure by unintended impeller contact with either the case 36 or the insert 162. One suitable preferred soft material insert is disclosed in copending application for U.S. Letters patent Ser. No. 10/349,411, filed Jan. 22, 2003, entitled A METHOD AND APPARATUS FOR INCREASING THE ADIABATIC EFFICIENCY OF A CENTRIFUGAL SUPERCHARGER (see U.S. Patent Publication No. 20040109760), which claims the priority of provisional U.S.

Application Ser. No. 60/430,814, filed Dec. 4, 2002 and bearing the same title, both of which are hereby incorporated by reference herein.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A centrifugal compressor being driven by a power source to supply compressed fluid, said centrifugal compressor comprising:

a case;

a compressor chamber extending between an inlet opening and a spaced outlet opening;

a rotatable impeller in the compressor chamber, with the impeller being operable to compress fluid from the inlet opening and force compressed fluid through the outlet opening when rotated by the power source; and a rotatable insert encircling at least a portion of the impeller, said insert and said case each defining at least a portion of the compressor chamber, said insert being rotatable relative to the case, said insert being caused to rotate by the impeller as a result of contact therebetween, said insert being stationary during compression of the fluid, except when caused to rotate by contact with the impeller.

2. The centrifugal compressor as claimed in claim 1, said insert rotating at a speed that is less than that of the impeller.

3. The centrifugal compressor as claimed in claim 1, said case presenting a transmission chamber; and a gear-type transmission operable to drivingly connect the impeller to the power source, with at least part of the transmission being located in the transmission chamber.

4. The centrifugal compressor as claimed in claim 1, said case having a substantially cylindrical inlet portion that defines the inlet opening, said inlet portion being at least substantially coaxial with the impeller, said insert being entirely located within the inlet portion.

5. The centrifugal compressor as claimed in claim 1, said impeller including a plurality of impeller vanes that cooperatively define an impeller inducer and an impeller exducer, at least some of said vanes presenting a radially outermost curved edge extending between the inducer and exducer, said insert presenting an inner annular curved surface that complements the curved edges and extends therealong in close proximity thereto.

6. The centrifugal compressor as claimed in claim 1, said impeller including an impeller tip, said insert presenting an inner annular surface, said surface extending axially from the impeller tip toward the inlet opening.

7. The centrifugal compressor as claimed in claim 6, said surface extending axially from the impeller tip to the inlet opening.

8. A centrifugal compressor being driven by a power source to supply compressed fluid, said centrifugal compressor comprising;

a case;

a compressor chamber extending between an inlet opening and a spaced outlet opening;

a rotatable impeller in the compressor chamber, with the impeller being operable to compress fluid from the inlet opening and force compressed fluid through the outlet opening when rotated by the power source;

a rotatable insert encircling at least a portion of the impeller, said insert and said case each defining at least a portion of the compressor chamber, said insert being rotatable relative to the case; and a bearing rotatably supporting said insert on the case.

9. The centrifugal compressor as claimed in claim 8, said bearing including first and second races, said first race being fixed to said case and said second race being fixed to said insert, said races being rotatable relative to each other.

10. The centrifugal compressor as claimed in claim 9, said bearing including a ball ring interposed between the first and second races thereof.

11. A centrifugal compressor being driven by a power source to supply compressed fluid, said centrifugal compressor comprising:

a case;

a compressor chamber extending between an inlet opening and a spaced outlet opening;

a rotatable impeller in the compressor chamber, with the impeller being operable to compress fluid from the inlet opening and force compressed fluid through the outlet opening when rotated by the power source;

a rotatable insert encircling at least a portion of the impeller, said insert and said case each defining at least a portion of the compressor chamber, said insert being rotatable relative to the case; and a seal assembly providing a sealed relationship between the case and insert, said seal assembly being fixed to the case and encircling and sealingly contacting a portion of the insert.

12. A centrifugal compressor being driven by a power source to supply compressed fluid, said centrifugal compressor comprising:

a case;

a compressor chamber extending between an inlet opening and a spaced outlet opening;

a rotatable impeller in the compressor chamber, with the impeller being operable to compress fluid from the inlet opening and force compressed fluid through the outlet opening when rotated by the power source;

a rotatable insert encircling at least a portion of the impeller;

said insert and said case each defining at least a portion of the compressor chamber, said insert being rotatable relative to the case, said case having a substantially cylindrical inlet portion that defines the inlet opening, said inlet portion being at least substantially coaxial with the impeller, said insert including a cylindrical section that is concentric with the inlet portion and a curved section projecting from the cylindrical section;

a seal assembly providing a sealed relationship between the case and insert, said seal assembly being fixed to the inlet portion and encircling and sealingly contacting the cylindrical section; and a bearing interposed between the inlet portion and cylindrical section to rotatably support the insert on the case.

13. The centrifugal compressor as claimed in claim 12, said impeller including a plurality of impeller vanes that cooperatively define an impeller inducer and an impeller exducer, at least some of said vanes presenting a radially outermost curved edge extending between the inducer and exducer, said curved section and said curved edges presenting complemental shapes and extending along and being in close proximity to one another.

14. A centrifugal compressor being driven by a power source to supply compressed fluid, said centrifugal compressor comprising:

a case;

a rotatable impeller operable to compress fluid when rotated by the power source; and a rotatable insert being spaced from the impeller and encircling at least a portion of the impeller, said insert being rotatably supported on the case to spin relative thereto in response to contact with the rotatable impeller.

15. The centrifugal compressor as claimed in claim 14, said insert being stationary during compression of the fluid, except when caused to rotate by contact with the impeller.

16. The centrifugal compressor as claimed in claim 15, said insert rotating at a speed that is less than that of the impeller.

17. The centrifugal compressor as claimed in claim 14, said case presenting a transmission chamber; and a gear-type transmission operable to drivingly connect the impeller to the power source, with at least part of the transmission being located in the transmission chamber.

18. The centrifugal compressor as claimed in claim 14, said case and said insert each defining at least a portion of a compressor chamber that extends between an inlet opening and a spaced outlet opening, with the impeller being operable to compress fluid from the inlet opening and force compressed fluid through the outlet opening when rotated by the power source, said case having a substantially cylindrical inlet portion that defines the inlet opening, said inlet portion being at least substantially coaxial with the impeller, said insert being entirely located within the inlet portion.

19. The centrifugal compressor as claimed in claim 14; and a bearing rotatably supporting said insert on the case.

20. The centrifugal compressor as claimed in claim 19, said bearing including first and second races, said first race being fixed to said case and said second race being fixed to said insert, said races being rotatable relative to each other.

21. The centrifugal compressor as claimed in claim 20, said bearing including a ball ring interposed between the first and second races thereof.

22. The centrifugal compressor as claimed in claim 14; and a seal assembly providing a sealed relationship between the case and insert, said seal assembly being fixed to the case and encircling and sealingly contacting a portion of the insert.

23. The centrifugal compressor as claimed in claim 14, said impeller including a plurality of impeller vanes that cooperatively define an impeller inducer and an impeller exducer, at least some of said vanes presenting a radially outermost curved edge extending between the inducer and exducer, said case and said insert each defining at least a portion of a compressor chamber that extends between an inlet opening and a spaced outlet opening, with the impeller being operable to compress fluid from the inlet opening and force compressed fluid through the outlet opening when rotated by the power source, said insert presenting an inner annular curved surface that complements the curved edges and extends therealong in close proximity thereto.

24. The centrifugal compressor as claimed in claim 14, said impeller including an impeller tip, said case and said insert each defining at least a portion of a compressor chamber that extends between an inlet opening and a spaced outlet opening, with the impeller being operable to compress fluid from the inlet opening and force compressed fluid through the outlet opening when rotated by the power source, said insert presenting an inner annular surface, said surface extending axially from the impeller tip toward the inlet opening.

25. The centrifugal compressor as claimed in claim 24, said surface extending axially from the impeller tip to the inlet opening.

26. The centrifugal compressor as claimed in claim 14, said case and said insert each defining at least a portion of a compressor chamber that extends between an inlet opening and a spaced outlet opening, with the impeller being operable to compress fluid from the inlet opening and force compressed fluid through the outlet opening when rotated by the power source, said case having a substantially cylindrical inlet portion that defines the inlet opening, said inlet portion being at least substantially coaxial with the impeller, said insert including a cylindrical section that is concentric with the inlet portion and a curved section projecting from the cylindrical section.

27. The centrifugal compressor as claimed in claim 26, a seal assembly providing a sealed relationship between the case and insert, said seal assembly being fixed to the inlet portion and encircling and sealingly contacting the cylindrical section; and a bearing interposed between the inlet portion and cylindrical section to rotatably support the insert on the case.

28. The centrifugal compressor as claimed in claim 27, said rotatable impeller including a plurality of impeller vanes that cooperatively define an impeller inducer and an impeller exducer, at least some of said vanes presenting a radially outermost curved edge extending between the inducer and exducer, said curved section and said curved edges presenting complemental shapes and extending along and being in close proximity to one another.

29. A centrifugal compressor being driven by a power source to supply compressed fluid, said centrifugal compressor comprising:

a case;

a rotatable impeller operable to compress fluid when rotated by the power source about an impeller axis; and a case insert assembly including an insert adjacent the impeller, and a bearing rotatably supporting the insert on the case for rotation about the impeller axis.

30. The centrifugal compressor as claimed in claim 29, said insert being caused to rotate by the impeller as a result of contact therebetween.

31. The centrifugal compressor as claimed in claim 30, said insert being stationary during compression of the fluid, except when caused to rotate by contact with the impeller.

32. The centrifugal compressor as claimed in claim 31, said insert rotating at a speed that is less than that of the impeller.

33. The centrifugal compressor as claimed in claim 29, said case presenting a transmission chamber; and a gear-type transmission operable to drivingly connect the impeller to the power source, with at least part of the transmission being located in the transmission chamber.

34. The centrifugal compressor as claimed in claim 29, said case and said insert each defining at least a portion of a compressor chamber that extends between an inlet opening and a spaced outlet opening, with the impeller being operable to compress fluid from the inlet opening and force compressed fluid through the outlet opening when rotated by the power source, said case having a substantially cylindrical inlet portion that defines the inlet opening, said inlet portion being at least substantially coaxial with the impeller, said insert being entirely located within the inlet portion.

35. The centrifugal compressor as claimed in claim 29, said bearing including first and second races, said first race being fixed to said case and said second race being fixed to said insert, said races being rotatable relative to each other.

36. The centrifugal compressor as claimed in claim 35, said bearing including a ball ring interposed between the first and second races thereof.

37. The centrifugal compressor as claimed in claim 29, said case insert assembly including a seal assembly operable to provide a sealed relationship between the case and insert, said seal assembly being fixed to the case and encircling and sealingly contacting a portion of the insert.

38. The centrifugal compressor as claimed in claim 29, said impeller including a plurality of impeller vanes that cooperatively define an impeller inducer and an impeller exducer, at least some of said vanes presenting a radially outermost curved edge extending between the inducer and exducer, said case and said insert each defining at least a portion of a compressor chamber that extends between an inlet opening and a spaced outlet opening, with the impeller being operable to compress fluid from the inlet opening and force compressed fluid through the outlet opening when rotated by the power source, said insert presenting an inner annular curved surface that complements the curved edges and extends therealong in close proximity thereto.

39. The centrifugal compressor as claimed in claim 29, said impeller including an impeller tip, said case and said insert each defining at least a portion of a compressor chamber that extends between an inlet opening and a spaced outlet opening, with the impeller being operable to compress fluid from the inlet opening and force compressed fluid through the outlet opening when rotated by the power source, said insert presenting an inner annular surface, said surface extending axially from the impeller tip toward the inlet opening.

40. The centrifugal compressor as claimed in claim 39, said surface extending axially from the impeller tip to the inlet opening.

41. The centrifugal compressor as claimed in claim 29, said case and said insert each defining at least a portion of a compressor chamber that extends between an inlet opening and a spaced outlet opening, with the impeller being operable to compress fluid from the inlet opening and force compressed fluid through the outlet opening when rotated by the power source, said case having a substantially cylindrical inlet portion that defines the inlet opening, said inlet portion being at least substantially coaxial with the impeller, said insert including a cylindrical section that is concentric with the inlet portion and a curved section projecting from the cylindrical section.

42. The centrifugal compressor as claimed in claim 41, said case insert assembly including a seal assembly operable to provide a sealed relationship between the case and insert, said seal assembly being fixed to the inlet portion and encircling and sealingly contacting the cylindrical section, said bearing being interposed between the inlet portion and cylindrical section.

43. The centrifugal compressor as claimed in claim 42, said rotatable impeller including a plurality of impeller vanes that cooperatively define an impeller inducer and an impeller exducer, at least some of said vanes presenting a radially outermost curved edge extending between the inducer and exducer, said curved section and said curved edges presenting complemental shapes and extending along and being in close proximity to one another.

44. A forced air induction system for providing compressed intake fluid to an engine, said system comprising:

a centrifugal compressor operable to compress the intake fluid, said compressor including a case, a compressor chamber extending between an inlet opening and a spaced outlet opening, with the outlet opening being fluidly connectable to the engine, a rotatable impeller in the compressor chamber, with the impeller being operable to compress fluid from the inlet opening and force compressed fluid through the outlet opening when rotated, and a rotatable insert encircling at least a portion of the impeller, said insert and said case each defining at least a portion of the compressor chamber, said insert being rotatable relative to the case, said insert being caused to rotate by the impeller as a result of contact therebetween, said insert being stationary during compression of the intake fluid, except when caused to rotate by contact with the impeller.

45. The forced air induction system as claimed in claim 44, said insert rotating at a speed that is less than that of the impeller.

46. The forced air induction system as claimed in claim 44, said case presenting a transmission chamber, said compressor including a gear-type transmission, with at least part of the transmission being located in the transmission chamber.

47. The forced air induction system as claimed in claim 44, said case having a substantially cylindrical inlet portion that defines the inlet opening, said inlet portion being at least substantially coaxial with the impeller, said insert being entirely located within the inlet portion.

48. The forced air induction system as claimed in claim 44, said impeller including a plurality of impeller vanes that cooperatively define an impeller inducer and an impeller exducer, at least some of said vanes presenting a radially outermost curved edge extending between the inducer and exducer, said insert presenting an inner annular curved surface that complements the curved edges and extends therealong in close proximity thereto.

49. The forced air induction system as claimed in claim 44, said impeller including an impeller tip, said insert presenting an inner annular surface, said surface extending axially from the impeller tip toward the inlet opening.

50. The forced air induction system as claimed in claim 49, said surface extending axially from the impeller tip to the inlet opening.

51. A forced air induction system for providing compressed intake fluid to an engine, said system comprising:

a centrifugal compressor operable to compress the intake fluid, said compressor including a case, a compressor chamber extending between an inlet opening and a spaced outlet opening, with the outlet opening being fluidly connectable to the engine, a rotatable impeller in the compressor chamber, with the impeller being operable to compress fluid from the inlet opening and force compressed fluid through the outlet opening when rotated, and a rotatable insert encircling at least a portion of the impeller, said insert and said case each defining at least a portion of the compressor chamber, said insert being rotatable relative to the case, said case presenting a transmission chamber, said compressor including a gear-type transmission, with at least part of the transmission being located in the transmission chamber; and a drive unit operable to drivingly connect the transmission to the engine so that impeller rotation is mechanically powered by the engine.

52. A forced air induction system for providing compressed intake fluid to an engine, said system comprising:

a centrifugal compressor operable to compress the intake fluid, said compressor including a case, a compressor chamber extending between an inlet opening and a spaced outlet opening, with the outlet opening being fluidly connectable to the engine, a rotatable impeller in the compressor chamber, with the impeller being operable to compress fluid from the inlet opening and force compressed fluid through the outlet opening when rotated, a rotatable insert encircling at least a portion of the impeller, said insert and said case each defining at least a portion of the compressor chamber, said insert being rotatable relative to the case, and a bearing rotatably supporting said insert on the case.

53. The forced air induction system as claimed in claim 52, said bearing including first and second races, said first race being fixed to said case and said second race being fixed to said insert, said races being rotatable relative to each other.

54. The forced air induction system as claimed in claim 53, said bearing including a ball ring interposed between the first and second races thereof.

55. A forced air induction system for providing compressed intake fluid to an engine, said system comprising:

a centrifugal compressor operable to compress the intake fluid, said compressor including a case, a compressor chamber extending between an inlet opening and a spaced outlet opening, with the outlet opening being fluidly connectable to the engine, a rotatable impeller in the compressor chamber, with the impeller being operable to compress fluid from the inlet opening and force compressed fluid through the outlet opening when rotated, a rotatable insert encircling at least a portion of the impeller, said insert and said case each defining at least a portion of the compressor chamber, said insert being rotatable relative to the case, and a seal assembly providing a sealed relationship between the case and insert, said seal assembly being fixed to the case and encircling and sealingly contacting a portion of the insert.

56. A forced air induction system for providing compressed intake fluid to an engine, said system comprising:

a centrifugal compressor operable to compress the intake fluid, said compressor including a case, a compressor chamber extending between an inlet opening and a spaced outlet opening, with the outlet opening being fluidly connectable to the engine, a rotatable impeller in the compressor chamber, with the impeller being operable to compress fluid from the inlet opening and force compressed fluid through the outlet opening when rotated, a rotatable insert encircling at least a portion of the impeller, said insert and said case each defining at least a portion of the compressor chamber, said insert being rotatable relative to the case, said case having a substantially cylindrical inlet portion that defines the inlet opening, said inlet portion being at least substantially coaxial with the impeller, said insert including a cylindrical section that is concentric with the inlet portion and a curved section projecting from the cylindrical section, a seal assembly providing a sealed relationship between the case and insert, said seal assembly being fixed to the inlet portion and encircling and sealingly contacting the cylindrical section, and a bearing interposed between the inlet portion and cylindrical section to rotatably support the insert on the case.

57. The forced air induction system as claimed in claim 56, said impeller including a plurality of impeller vanes that cooperatively define an impeller inducer and an impeller exducer, at least some of said vanes presenting a radially outermost curved edge extending between the inducer and exducer, said curved section and said curved edges presenting complemental shapes and extending along and being in close proximity to one another.

58. A forced air induction system for providing compressed intake fluid to an engine, said system comprising:

a centrifugal compressor operable to compress the intake fluid, said compressor including a case, a rotatable impeller operable to compress the intake fluid when rotated, and a rotatable insert being spaced from the impeller and encircling at least a portion of the impeller, said insert being rotatably supported on the case to spin relative thereto in response to contact with the impeller.

59. The forced air induction system as claimed in claim 58, said insert being stationary during compression of the intake fluid, except when caused to rotate by contact with the impeller.

60. The forced air induction system as claimed in claim 59, said insert rotating at a speed that is less than that of the impeller.

61. The forced air induction system as claimed in claim 58, said case presenting a transmission chamber, said compressor including a gear-type transmission, with at least part of the transmission being located in the transmission chamber.

62. The forced air induction system as claimed in claim 61; and a drive unit operable to drivingly connect the transmission to the engine so that impeller rotation is mechanically powered by the engine.

63. The forced air induction system as claimed in claim 58, said case and said insert each defining at least a portion of a compressor chamber that extends between an inlet opening and a spaced outlet opening, with the outlet opening being fluidly connectable to the engine, said impeller being operable to compress fluid from the inlet opening and force compressed fluid through the outlet opening when rotated, said case having a substantially cylindrical inlet portion that defines the inlet opening, said inlet portion being at least substantially coaxial with the impeller, said insert being entirely located within the inlet portion.

64. The forced air induction system as claimed in claim 58, said compressor including a bearing rotatably supporting said insert on the case.

65. The forced air induction system as claimed in claim 64, said bearing including first and second races, said first race being fixed to said case and said second race being fixed to said insert, said races being rotatable relative to each other.

66. The forced air induction system as claimed in claim 65, said bearing including a ball ring interposed between the first and second races thereof.

67. The forced air induction system as claimed in claim 58, said compressor including a seal assembly providing a sealed relationship between the case and insert, said seal assembly being fixed to the case and encircling and sealingly contacting a portion of the insert.

68. The forced air induction system as claimed in claim 58, said impeller including a plurality of impeller vanes that cooperatively define an impeller inducer and an impeller exducer, at least some of said vanes presenting a radially outermost curved edge extending between the inducer and exducer, said case and said insert each defining at least a portion of a compressor chamber that extends between an inlet opening and a spaced outlet opening, with the outlet opening being fluidly connectable to the engine, said impeller being operable to compress fluid from the inlet opening and force compressed fluid through the outlet opening when rotated, said insert presenting an inner annular curved surface that complements the curved edges and extends therealong in close proximity thereto.

69. The forced air induction system as claimed in claim 58, said impeller including an impeller tip, said case and said insert each defining at least a portion of a compressor chamber that extends between an inlet opening and a spaced outlet opening, with the outlet opening being fluidly connectable to the engine, said impeller being operable to compress fluid from the inlet opening and force compressed fluid through the outlet opening when rotated, said insert presenting an inner annular surface, said surface extending axially from the impeller tip toward the inlet opening.

70. The forced air induction system as claimed in claim 69, said surface extending axially from the impeller tip to the inlet opening.

71. The forced air induction system as claimed in claim 58, said case and said insert each defining at least a portion of a compressor chamber that extends between an inlet opening and a spaced outlet opening, with the outlet opening being fluidly connectable to the engine, said impeller being operable to compress fluid from the inlet opening and force compressed fluid through the outlet opening when rotated, said case having a substantially cylindrical inlet portion that defines the inlet opening, said inlet portion being at least substantially coaxial with the impeller, said insert including a cylindrical section that is concentric with the inlet portion and a curved section projecting from the cylindrical section.

72. The forced air induction system as claimed in claim 71, said compressor including a seal assembly providing a sealed relationship between the case and insert, said seal assembly being fixed to the inlet portion and encircling and sealingly contacting the cylindrical section, said compressor including a bearing interposed between the inlet portion and cylindrical section to rotatably support the insert on the case.

73. The forced air induction system as claimed in claim 72, said rotatable impeller including a plurality of impeller vanes that cooperatively define an impeller inducer and an impeller exducer, at least some of said vanes presenting a radially outermost curved edge extending between the inducer and exducer, said curved section and said curved edges presenting complemental shapes and extending along and being in close proximity to one another.

74. A forced air induction system for providing compressed intake fluid to an engine, said system comprising:

a centrifugal compressor operable to compress the intake fluid, said compressor including a case;

a rotatable impeller operable to compress the intake fluid when rotated about an impeller axis; and a case insert assembly including an insert adjacent the impeller, and a bearing rotatably supporting the insert on the case for rotation about the impeller axis.

75. The forced air induction system as claimed in claim 74, said insert being caused to rotate by the impeller as a result of contact therebetween.

76. The forced air induction system as claimed in claim 75, said insert being stationary during compression of the intake fluid, except when caused to rotate by contact with the impeller.

77. The forced air induction system as claimed in claim 76, said insert rotating at a speed that is less than that of the impeller.

78. The forced air induction system as claimed in claim 74, said case presenting a transmission chamber, said compressor including a gear-type transmission, with at least part of the transmission being located in the transmission chamber.

79. The forced air induction system as claimed in claim 78; and a drive unit operable to drivingly connect the transmission to the engine so that impeller rotation is mechanically powered by the engine.

80. The forced air induction system as claimed in claim 74, said case and said insert each defining at least a portion of a compressor chamber that extends between an inlet opening and a spaced outlet opening, with the outlet opening being fluidly connectable to the engine, said impeller being operable to compress fluid from the inlet opening and force compressed fluid through the outlet opening when rotated, said case having a substantially cylindrical inlet portion that defines the inlet opening, said inlet portion being at least substantially coaxial with the impeller, said insert being entirely located within the inlet portion.

81. The forced air induction system as claimed in claim 74, said bearing including first and second races, said first race being fixed to said case and said second race being fixed to said insert, said races being rotatable relative to each other.

82. The forced air induction system as claimed in claim 81, said bearing including a ball ring interposed between the first and second races thereof.

83. The forced air induction system as claimed in claim 74, said case insert assembly including a seal assembly operable to provide a sealed relationship between the case and insert, said seal assembly being fixed to the case and encircling and sealingly contacting a portion of the insert.

84. The forced air induction system as claimed in claim 74, said impeller including a plurality of impeller vanes that cooperatively define an impeller inducer and an impeller exducer, at least some of said vanes presenting a radially outermost curved edge extending between the inducer and exducer, said case and said insert each defining at least a portion of a compressor chamber that extends between an inlet opening and a spaced outlet opening, with the outlet opening being fluidly connectable to the engine, said impeller being operable to compress fluid from the inlet opening and force compressed fluid through the outlet opening when rotated, said insert presenting an inner annular curved surface that complements the curved edges and extends therealong in close proximity thereto.

85. The forced air induction system as claimed in claim 74, said impeller including an impeller tip, said case and said insert each defining at least a portion of a compressor chamber that extends between an inlet opening and a spaced outlet opening, with the outlet opening being fluidly connectable to the engine, said impeller being operable to compress fluid from the inlet opening and force compressed fluid through the outlet opening when rotated, said insert presenting an inner annular surface, said surface extending axially from the impeller tip toward the inlet opening.

86. The forced air induction system as claimed in claim 85, said surface extending axially from the impeller tip to the inlet opening.

87. The forced air induction system as claimed in claim 74, said case and said insert each defining at least a portion of a compressor chamber that extends between an inlet opening and a spaced outlet opening, with the outlet opening being fluidly connectable to the engine, said impeller being operable to compress fluid from the inlet opening and force compressed fluid through the outlet opening when rotated, said case having a substantially cylindrical inlet portion that defines the inlet opening, said inlet portion being at least substantially coaxial with the impeller, said insert including a cylindrical section that is concentric with the inlet portion and a curved section projecting from the cylindrical section.

88. The forced air induction system as claimed in claim 87, said case insert assembly including a seal assembly operable to provide a sealed relationship between the case and insert, said seal assembly being fixed to the inlet portion and encircling and sealingly contacting the cylindrical section, said bearing being interposed between the inlet portion and cylindrical section.

89. The forced air induction system as claimed in claim 88, said rotatable impeller including a plurality of impeller vanes that cooperatively define an impeller inducer and an impeller exducer, at least some of said vanes presenting a radially outermost curved edge extending between the inducer and exducer, said curved section and said curved edges presenting complemental shapes and extending along and being in close proximity to one another.

* * * * *